US005242286A

United States Patent [19]

Arbogast et al.

[11] Patent Number: 5,242,286

[45] Date of Patent: Sep. 7, 1993

[54] INTERNAL GEAR PUMP

[75] Inventors: Franz Arbogast; Peter Piez, both of Heidenheim, Fed. Rep. of Germany

[73] Assignee: J. M. Voith GmbH, Fed. Rep. of Germany

[21] Appl. No.: 969,800

[22] Filed: Oct. 30, 1992

[30] Foreign Application Priority Data

Oct. 30, 1991 [DE] Fed. Rep. of Germany ..... 4135725

[51] Int. Cl.[5] ..... F01C 1/10

[52] U.S. Cl. ..... 418/168; 418/171

[58] Field of Search ..... 418/166, 168, 171, 167, 418/169, 170, 110

[56] References Cited

U.S. PATENT DOCUMENTS 1,624,099 4/1927 Haight ..... 418/169

5,135,371 8/1992 Arbogast et al. ..... 418/168

FOREIGN PATENT DOCUMENTS 2242233A 9/1991 United Kingdom .

*Primary Examiner*—Richard A. Bertsch

*Assistant Examiner*—Charles G. Freay

*Attorney, Agent, or Firm*—Marshall, O'Toole, Gerstein, Murray & Borun

[57] ABSTRACT

An internal gear pump is disclosed having at least two essentially identical internal gears and a pinion meshing with the internal gears, all being rotatably disposed in a housing, the axial dimension of which is substantially equal to the width of the gear and pinion teeth. The housing includes a suction connection and a pressure connection. The internal gears have radial through-bores for the medium to be pumped. A support is provided at the contacting surfaces of the internal gears near the pressure connection.

3 Claims, 2 Drawing Sheets

INTERNAL GEAR PUMP

BACKGROUND OF THE INVENTION

1. Field of the Invention

The invention relates to internally toothed gear pumps for producing high pressure and, more particularly, the invention relates to an internally toothed gear pump having at least two essentially identical internal gears and a common pinion which meshes with the internal gears.

2. Description of Related Technology

An internal gear pump is known from DE 41 04 397 A1, published Sep. 12, 1991 (and counterpart UK Patent Publication No. 2,242,233, published Sep. 25, 1991). Such a pump includes two essentially identical internal gears and a common pinion which meshes with the internal gears, all of which are rotatably disposed in a common housing, the axial dimension of which is substantially equal to the width of the gear and pinion teeth. The pump includes a suction connection and a pressure connection. The internal gears have radial through-bores for pumping a medium therethrough.

In general, internally toothed gear pumps have a gear with internal teeth, which mesh with a pinion having a smaller number of outer teeth in driving connection with the internal teeth of the gear. Typically, each tooth of such a pump is relatively narrow in relation to the diameter of the pinion and the internal gear, respectively. Therefore, the volumetric flow conveyed by the pump is limited due to the construction thereof since the volumetric flow is determined by the height and width of the teeth.

In order to increase the volumetric flow in an internal gear pump, it is already known that the pump can be equipped with two (and, if desired, more) internal gears. Because the simple widening of an internal gear tooth is limited because of manufacturing and technological limitations, an increase of the volume flow can only be achieved by arranging two (and, if desired, more) internal gears coaxially, which then mesh together with a one-piece pinion. An internal gear pump of this type is disclosed as a variation of the embodiment disclosed in DE 41 04 397 A1.

The operation of this type of internal gear pump is such that the internal gears driven together by the pinion should cooperate synergistically as if only a single internal gear was present. However, in practice, when a pair of internal gears are used in an internal gear pump, the internal gears are pushed apart hydraulically at their axial contact surfaces. Moreover, it has also been observed that a pair of forces is generated at the internal gears which slants the gears relative to one another, i.e. tilting them. The reason for these inadequacies, which particularly promote wear, lies in the type and manner of hydrostatic relief of the internal gear pairs. Hydrostatic relief is defined herein as a pressure differential occurring between the inner and outer sides of an internal gear. It has been found that the hydrostatic pressure at the outer gear surface is greater than the hydrostatic pressure at the inner, toothed surface of the gear.

SUMMARY OF THE INVENTION

An object of the invention is to eliminate the foregoing inadequacies and to provide an internal gear pump of the type described above in which the axial contacting surfaces of the internal gears are stabilized. Consequently, the internal gears driven together by the pinion behave as a single internal gear during operation, i.e., as a one-piece internal gear.

The foregoing object is accomplished by providing a support in the area of the axial contacting surfaces of the internal gears, located on the same side of the pump as the pressure connection.

Thus, according to the invention, during the pumping operation the internal gears are pressed together at their axial contacting surfaces and the hydrostatic relief of the pair of internal gears does not produce forces that can rotate the internal gears relative to one another. With respect to hydrostatic pressure (or load), the pump according to the invention ensures that each of the commonly driven internal gears can be considered individually and thus that the forces act on the gears symmetrically.

The invention will be explained in more detail in the description and claims below with the aid of the following drawings:

DETAILED DESCRIPTION OF THE INVENTION

Figure 1:
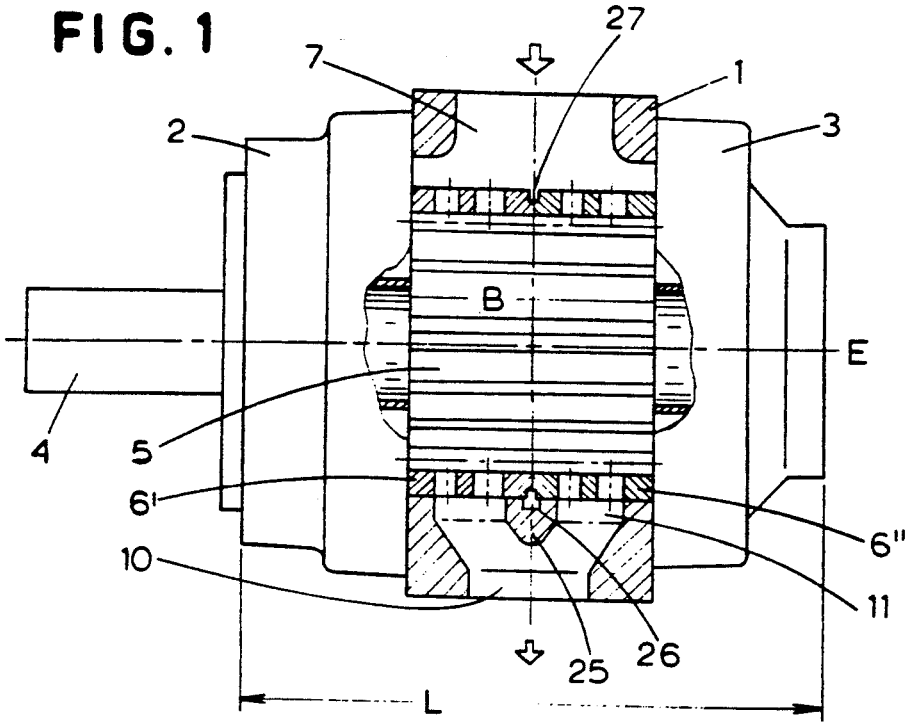
FIG. 1 is a longitudinal section (a portion of which is along line A-B of FIG. 2) of an internal gear pump according to the invention having one pair of internal gears.
Figure 2:
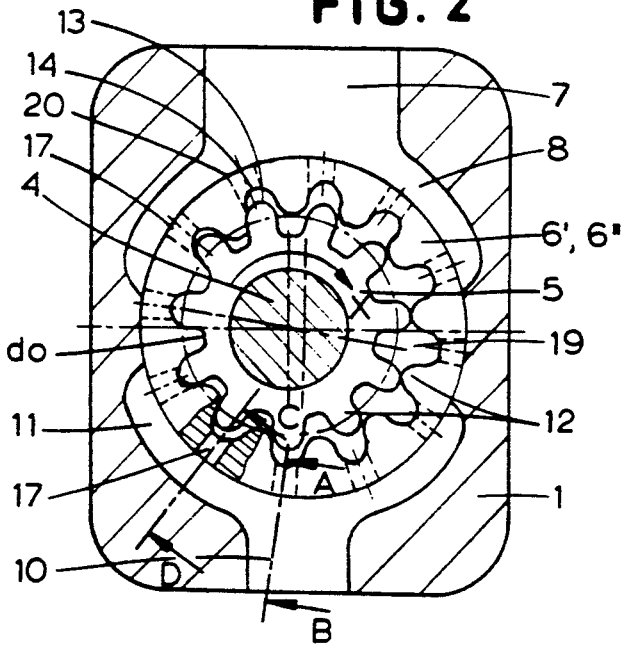
FIG. 2 is a cross-section of the pump according to FIG. 1 in the area of the meshing of the teeth between the pinion and the internal gears.

FIGS. 1 and 2 show a crescent-free, top-sealing internal gear pump, including housing elements 1, 2 and 3, a drive shaft 4, a pinion 5, a pair of internally toothed gears 6' and 6'', a suction connection 7, a suction pocket 8, a pressure connection 10, and a pressure pocket 11.

The internal gear pump is affected by play, and always seals with an edge, particularly in the area of the middle housing element 1, to which the other housing elements 2 and 3 are connected on both sides thereof. The entire internal gear pump with the housing elements 1, 2 and 3 has a total axial length of L. The drive shaft 4 is attached to the pinion 5 which includes external teeth which mesh with the teeth of the pair of coaxial internal gears 6' and 6''. (The teeth of the pinion 5 and the gears 6' and 6'' are designated by the reference numeral 12 herein.) The teeth 12 of the pinion 5 on the one hand, and of the internal gears 6' and 6'' on the other hand, have an axial width B and the pinion 5 has a rolling circle diameter $d_0$. The width B of the teeth is greater than the rolling circle diameter $d_0$. The pinion 5 is arranged eccentrically with the internal gears 6' and 6'', not coaxially. Furthermore, the pinion 5 has one tooth less than the internal gears 6' and 6'' so that the outside of a tooth head 13 on the pinion 5 always comes into contact an inside tooth base 14 of the internal gears 6' and 6''.

The suction connection 7 is in a zone wherein, upon rotation of the pinion 5 in the direction of the arrow X, the teeth of the pinion 5 and the teeth of the internal gears 6' and 6'' do not mesh. The suction pocket 8 connects to the suction connection 7 in the middle housing element 1, in which the internal gears 6' and 6'' and the pinion 5 are located and extends in an axial direction with respect to the neighboring housing elements 2 and 3. The pressure connection 10 is located on the internal gear pump opposite the suction connection 7 and joins the pressure pocket 11 which extends over a peripheral area of the internal gears 6' and 6''. A medium to be pumped (or a pressure medium) flows in from the suction connection 7, through the suction pocket 8, through the radial openings 17 in the internal gears 6' and 6'' and into gaps 19 between the teeth of the pinion 5 and the internal gears 6' and 6''. The openings 17 always start from a surface 20 of the internal gears 6' and 6'' and open into the tooth base 14 of the internal gears 6' and 6''. The suction pocket 8 extends over a portion of the surface 20.

The internal gear pump described above is representative of the state of the art (see DE 41 04 397 A1). With reference to the longitudinal cross-section represented in FIG. 1, it can be seen in principle that due to the direction of flow of a medium and the hydrostatic pressure on the internal gears 6' and 6'', the gears will be tilted relative to one another during pumping.

In order to prevent this tilting a priori, a support 25 is provided which bridges axial contacting surfaces of the internal gears 6' and 6'' on the side of the pump where the pressure connection 10 is located. The axial contacting surfaces of the internal gears 6' and 6'' are designated by the reference letter E. The support 25 is designed as an integral part of the middle housing element 1 and serves as a support for the area of the internal gears 6' and 6'', and adjoins the axial contacting surfaces E of the gears 6' and 6''. As a result of the support 25, the internal gears 6' and 6'' are fixed precisely in their mounted position.

A further aspect of the pump according to the invention includes relief grooves 26 and 27 defined in the support 25 and the gears 6' and 6'' respectively. The grooves 26 and 27 are located in the area E of axial contact of the internal gears 6' and 6'', are joined together and to the contact surface of the axial contacting surfaces E, communicate with one another, and are open toward the suction connection 7.

Figure 3:
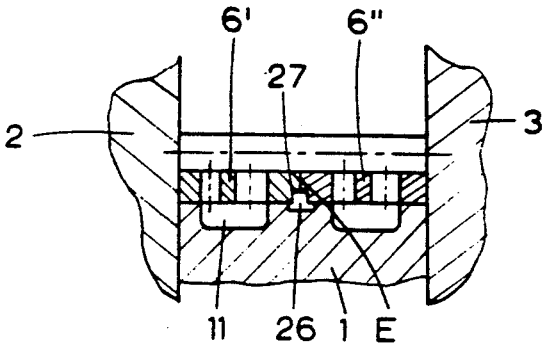
FIG. 3 is a partial longitudinal section of the pump according to FIG. 1, taken along line C-D of FIG. 2 and in the area of the neighboring axial contacting surfaces of the internal gears.

FIG. 3 shows a section of the internal gear pump according to FIG. 1, along line C-D of FIG. 2 in the area where the axial contacting surfaces E of the internal gears 6' and 6'' lie against one another. It can be seen from FIG. 3 that the support 25 is part of the middle housing element 1. The recesses that adjoin and are located on both sides of support 25 are portions of the pressure pocket 11.

Figure 4:
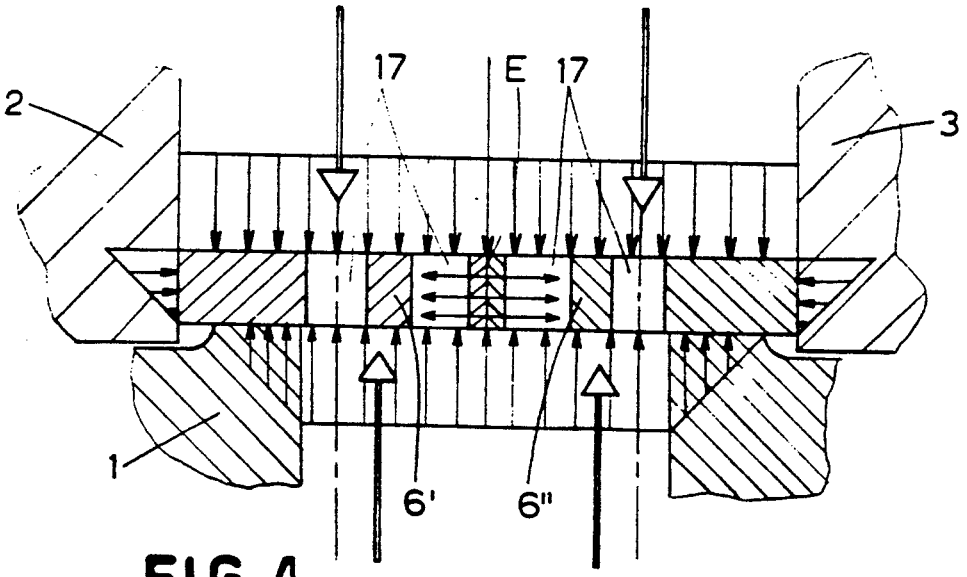
FIG. 4 is a partial longitudinal section according to FIG. 1, shown without a support to demonstrate the forces acting on the pair of internal gears.
Figure 5:
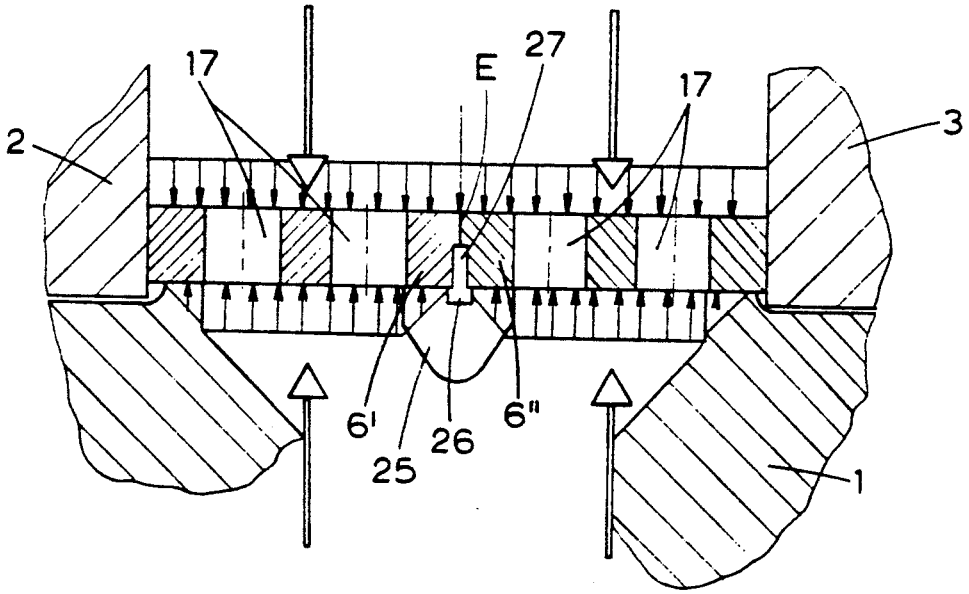
FIG. 5 is a section according to FIG. 4 shown with a support to demonstrate the action of the support.
Figure 6:
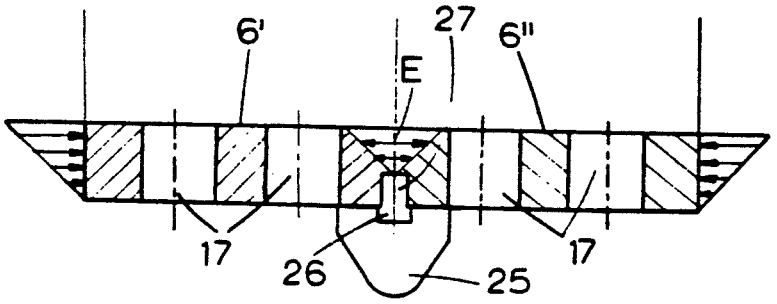
FIG. 6 is a section according to FIG. 5 demonstrating the axial force acting on the pair of internal gears.

The operation of the support 25 according to the invention is explained in more detail with the aid of FIGS. 4, 5, and 6. In all three drawings, a pair of internal gears 6' and 6'' is shown, on which certain forces act, indicated by arrows.

FIG. 4 shows an enlarged section of FIG. 1, but without a support 25. The two internal gears 6' and 6'' are placed in the housing elements 2 and 3 and rest on carrier shoulders of the middle housing element 1. Each of the internal gears 6' and 6'' has radial through-bores 17 through which a medium is transported from the inside of the internal gear pump (the pressure chamber between the pinion and the internal gears, i.e. the gaps 19) to the pressure connection 10.

The hydrostatic relief of the internal gears produces axial forces acting on the axial contacting surfaces which are greater than the forces acting on the outside surface 20 of the gears. This produces a resulting axial force, which attempts to push the internal gears away from one another. On the other hand, the construction is such that the forces that act on the internal gears in the direction of movement and the forces arising from hydrostatic relief do not overlap exactly. Thus, displaced attacking forces are produced, which result in a pair of forces that exert a torque on the internal gears 6' and 6''.

Now, if the pair of internal gears is supported by the support 25 as shown in FIG. 5, then the forces arising from the hydrostatic relief on the internal gears 6' and 6'' overlap exactly diametrically. Thus, there is an approximate equilibrium of forces on the internal gears 6' and 6'' and consequently, the internal gears 6' and 6'' cannot be tilted.

FIG. 6 shows that because of the support 25, the forces acting on the axial contacting surfaces E of the internal gears 6' and 6'' are influenced in such a way that there is a resulting force which presses the internal gears 6' and 6'' together. This latter effect is improved by the action of the relief grooves 26 and 27.

The invention disclosed above can be employed effectively, not only in connection with the crescent-free internal gear pumps disclosed in DE 41 04 397 A1, but also with internal gear pumps having a crescent. The present invention is also applicable to internal gear pumps with axial transport.

We claim:

1. An internal gear pump for pumping a medium comprising at least two coaxial essentially identical internal gears having axial contacting surfaces, each gear having internal teeth, and a common pinion disposed eccentrically with respect to said gears, said pinion having teeth adapted to mesh with the teeth of each said gear, said gears and pinion being rotatably disposed in a housing having an axial dimension substantially equal to the width of said gear and pinion teeth, said housing including a suction connection and a pressure connection, said gears having radial through-bores for the medium to be pumped, and a support located at the contacting surfaces of the internal gears near the pressure connection.

2. The internal gear pump of claim 1 wherein the support defines a groove open to the suction connection.

3. The internal gear pump of claim 2 wherein said gears define corresponding grooves at the contacting surfaces thereof adjoining the support groove.

* * * * *